US007708554B2

(12) United States Patent
Tsai

(10) Patent No.: US 7,708,554 B2
(45) Date of Patent: May 4, 2010

(54) SAFETY STRUCTURE OF A GAS BURNER

(76) Inventor: Chih-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 789 days.

(21) Appl. No.: 11/590,911

(22) Filed: Nov. 1, 2006

(65) Prior Publication Data

US 2008/0057455 A1 Mar. 6, 2008

(30) Foreign Application Priority Data

Aug. 31, 2006 (TW) ..... 95215440 U

(51) Int. Cl.
*F23D 14/72* (2006.01)

(52) U.S. Cl. ..... 431/153; 431/255

(58) Field of Classification Search ..... 431/153, 431/255, 344, 345

See application file for complete search history.

(56) References Cited

U.S. PATENT DOCUMENTS 6,196,833 B1 * 3/2001 Ho ..... 431/153
6,293,782 B1 * 9/2001 Tsai ..... 431/153
6,296,476 B1 * 10/2001 Tsai ..... 431/153
6,527,543 B2 * 3/2003 Tsai ..... 431/153
6,663,383 B2 * 12/2003 Jon ..... 431/153
6,688,879 B2 * 2/2004 Tsai ..... 431/153
6,887,072 B2 * 5/2005 Judeng ..... 431/153
6,988,884 B2 * 1/2006 Wong ..... 431/153

* cited by examiner

*Primary Examiner*—Alfred Basichas
(74) *Attorney, Agent, or Firm*—Guice Patents PLLC

(57) ABSTRACT

A safety structure of a gas burner is disclosed formed of a slide, a stop device and a housing. When pressed the slide, a third spring member is compressed to lower the stop device and to further disengage the retaining blocks of the stop device from respective retaining grooves of the slide, thereby releasing the stop device from the constraint of the slide. When the user keeps pressing the slide at this time, the retaining blocks are moved to a bottom side of the guide ribs of the slide and the frame base is forced to squeeze a first spring member to release the locked state.

16 Claims, 9 Drawing Sheets

SAFETY STRUCTURE OF A GAS BURNER

BACKGROUND OF THE INVENTION

1. Field of the Invention

The present invention relates to a gas burner and more specifically, to a safety structure of a gas burner.

2. Description of the Related Art

Following the movement of time, gas lighters are commonly used to make fire instead of matches. Further, handy gas burners, for example, hand gas torches are popularly accepted by consumers for the advantages of high mobility and ease of use. However, these handy gas burners must be kept away from reach of children. Because conventional handy gas burners can easily accidentally be triggered to make fire, they are not safe in use. There are numerous instances of fire accidents caused by children playing with gas burners. For easy use, the ignition switch of a conventional gas burner is not locked or can easily be unlocked, and a child may switch on the ignition switch accidentally when playing with the gas burner, thereby causing an accident.

Therefore, many countries have made relevant safety regulations stipulating installation of safety devices on gas burners, such as those disclosed in U.S. Pat. No. 6,293,782 (equivalent to Taiwan Patent Publication No. 446104), U.S. Pat. No. 6,296,476 (equivalent to Taiwan Patent Publication No. 449018), U.S. Pat. No. 6,527,543 (equivalent to Taiwan Patent Publication No. 525749), U.S. Pat. No. 6,688,879 (equivalent to Taiwan Patent Publication No. 534277), and Taiwan Patent Publication No. 582519. The aforesaid various patents are issued to the present inventor. According to these patents, when a gas burner is not in use, it is in a locked state. To use the gas burner, the safety device has to be released. The releasing operation is quite complicated, thereby making it relatively difficult for children to conduct.

SUMMARY OF THE INVENTION

According to one aspect of the present invention, the safety structure of a gas rubber comprises a slide, the slide having a frame base accommodating a first spring means, a key from the frame base, two upright rods arranged in parallel at a top side of the frame base, a guide way defined between the upright rods, two transverse retaining grooves respectively formed on the upright rods at an inner side, and a pair of guide ribs respectively transversely provided at the upright rods at a bottom side; a stop device received in the sliding way of the slide, the stop device having a stop plate, a finger strip forwardly extending from the stop plate, a guide strip and a pin backwardly extending from the stop plate, two retaining blocks respectively extended from left and right sides of the stop plate for engaging the retaining grooves of the slide to lock the slide, two recessed portions respectively defined between the stop plate and the retaining blocks, and a third spring means mounted on the pin; and a housing formed of two cover shells, the housing having a longitudinal sliding slot and a guide way for the passing of the key and the finger strip respectively, a frame wall transversely disposed below the guide way and stopped against the third spring means, and a sliding slot cut through the frame wall for the passing of the guide strip. When the user presses the slide, the third spring will be compressed to lower the stop device and to further disengage the retaining blocks from the retaining grooves, thereby releasing the stop device from the constraint of the slide, and when the user keeps pressing the slide at this time, the retaining blocks will be moved to a bottom side of the guide ribs and the frame base will be forced to squeeze the first spring means to release the locked state.

According to another aspect of the present invention, the frame base of the slide has an extension wall backwardly extending one side thereof, a protruding rod perpendicularly extended from the extension wall, and a second spring means connected to the protruding rod; the housing has chamber accommodating the second spring means for enabling the second spring means to be compressed when the slide is moved.

According to still another aspect of the present invention, the safety structure further comprises a swinging member, the swinging member having a center pivot hole coupled to an axle inside the housing, a driving end coupled to a gas valve of a butane well, and a driven end connected to the slide, the swinging member being turned about the axle to lift open the gas valve when the slide is pressed.

According to still another aspect of the present invention, the safety structure further comprises a release-lock switch mounted in a hole on the housing, the release-lock switch having a front stop block movable from an unlocking position to a locking position above a protruding strip of the slide to prohibit upward movement of the slide and to lock the slide in the released state after the slide has pressed and the swinging member has been driven to open the gas valve.

According to still another aspect of the present invention, the safety structure further comprises a butane well holding a liquid fuel gas, the butane well having a top connector fastened to the housing, and a plurality of locating blocks protruded from the top connector and respectively engaged into respective retaining notches in a bottom cuff of the housing, a gas valve supported on an absorptive seat at a top side of the top connector, a flame adjustment wheel operable to regulate the flow rate of the fuel gas passing out of the butane well through the gas valve, and a handle fastened to the flame adjustment wheel and extended out of a hole of the housing for operation.

According to still another aspect of the present invention, the safety structure further comprises a burner. The burner comprises a flexible gas tube connected to the gas valve3, a gas nozzle connected between one end of the flexible gas tube remote from the gas valve and a mixing tube that is fixedly mounted in a positioning hole of a top neck of the housing and has at least one air hole for receiving outside air for mixing with discharged fuel gas for combustion, a flame nozzle connected to the mixing tube, and a heat insulative ring mounted around the flame nozzle for protection.

BRIEF DESCRIPTION OF THE DRAWINGS

The present invention can be more fully understood by referring to the following description and accompanying drawings, in which.

DETAILED DESCRIPTION OF THE PREFERRED EMBODIMENT

Figure 1:
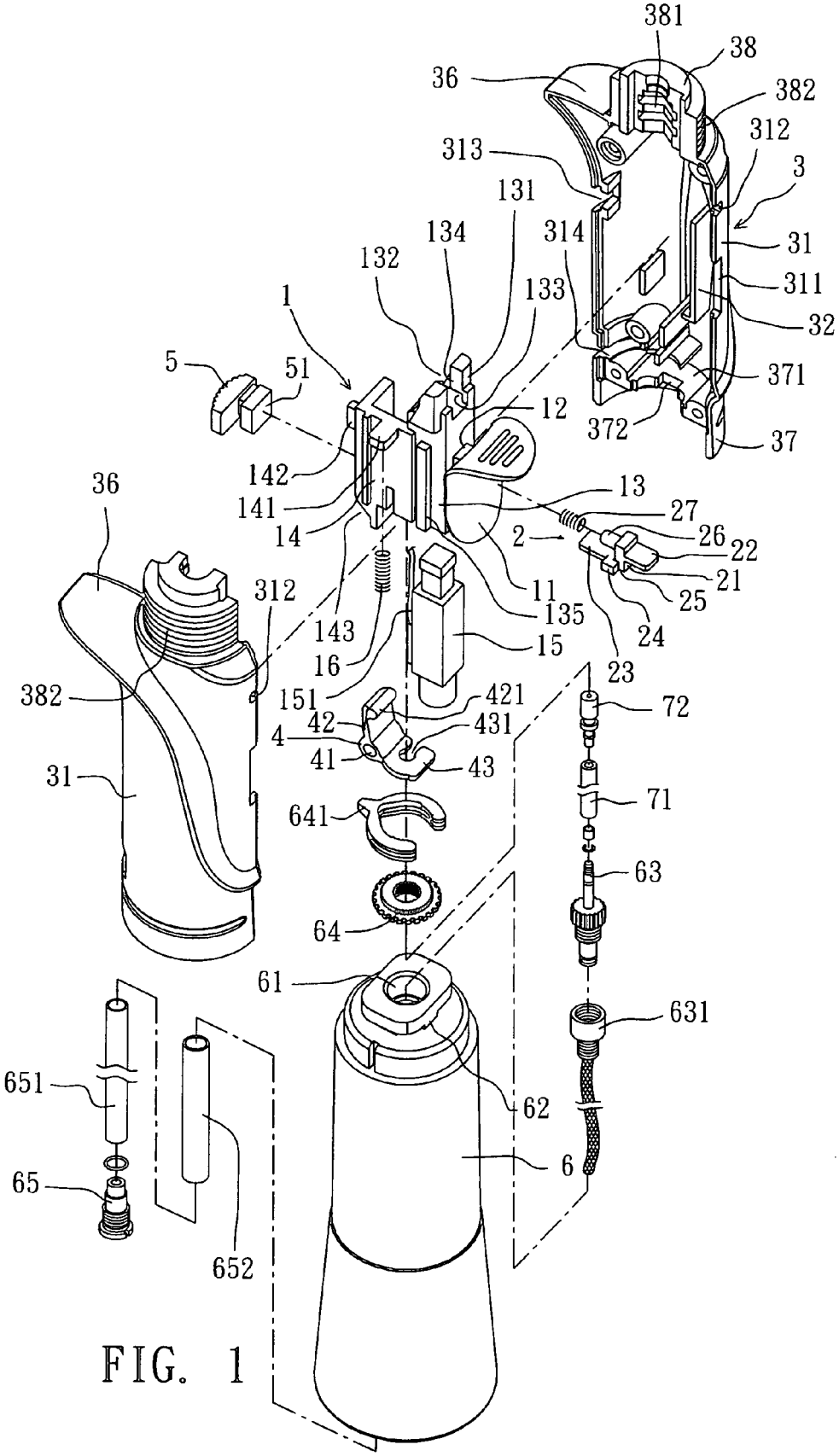
FIG. 1 is an exploded view of a gas burner embodying the present invention.
Figure 2A:
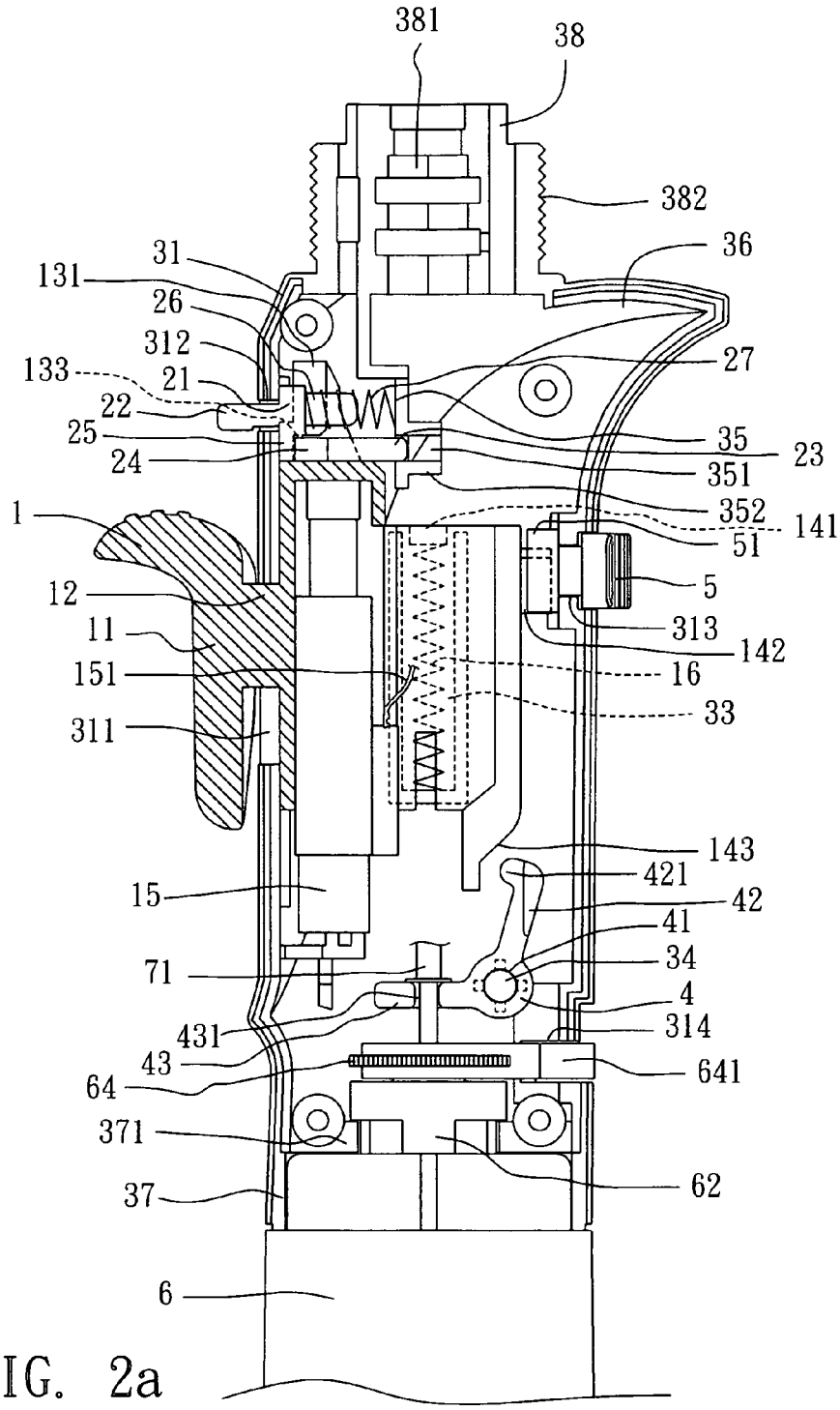
FIGS. 2*a*~2*c* are sectional views explaining the release and release lock operation procedure of the present invention.
Figure 2B:
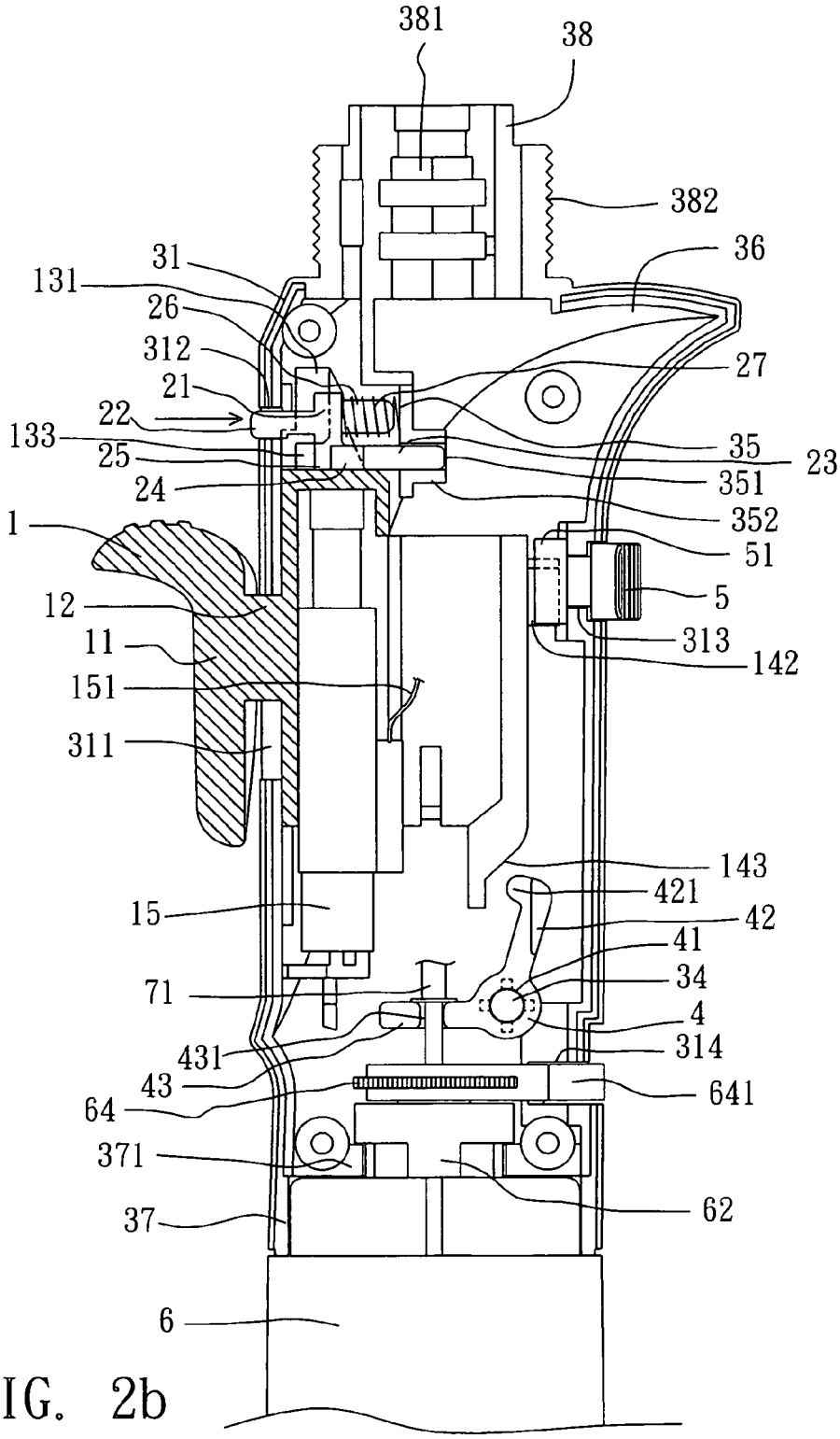
Figure 2C:
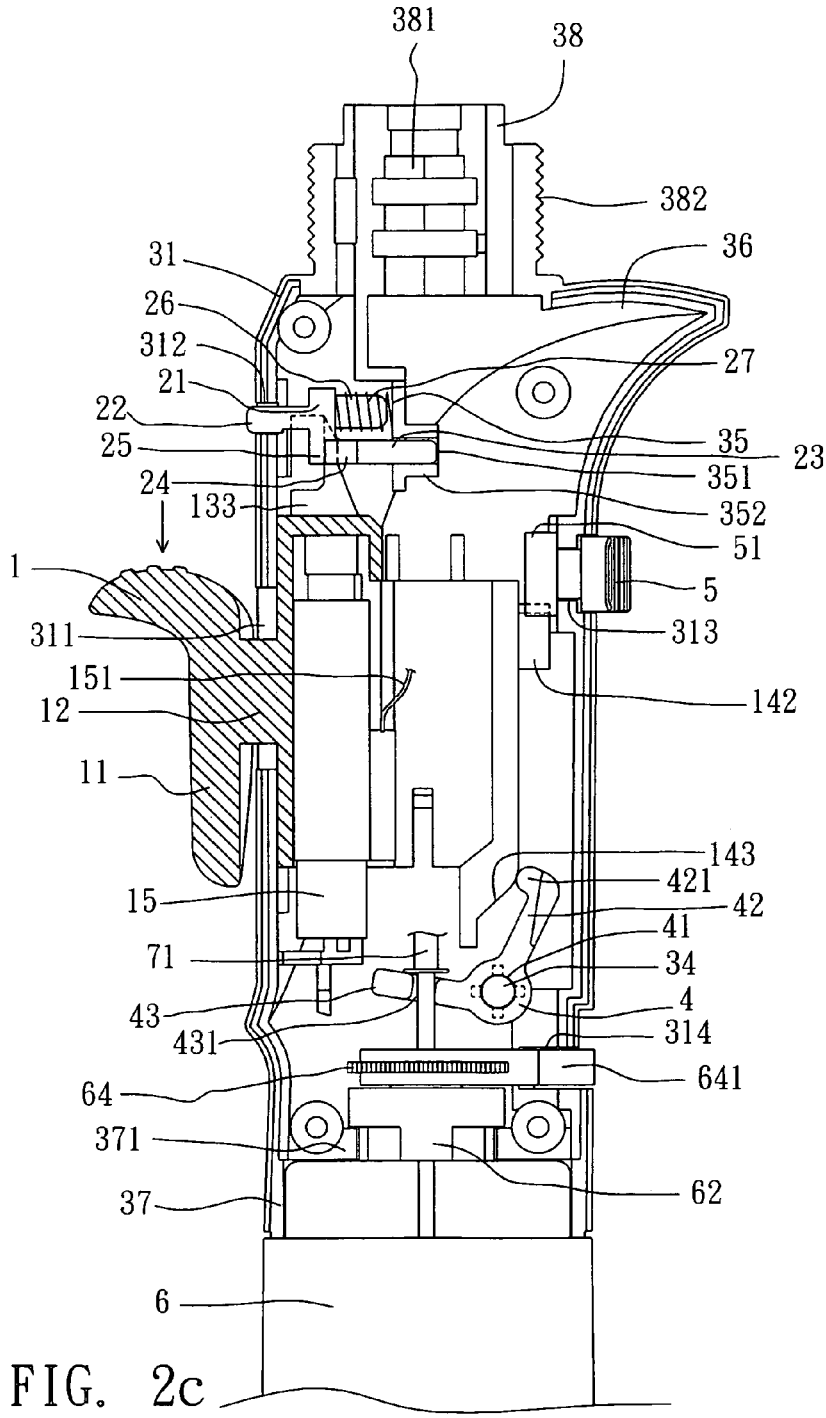

Referring to FIGS. 1 and 2*a*~2*c*, a safety structure of a gas burner in accordance with the present invention is shown comprising a slide 1 and a stop device 2. The slide 1 and the stop device 2 are mounted in a housing 3.

The slide 1 has a frame base 13 mounted inside the housing 3, a shank 12 extended from one side of the frame base 13 through a longitudinal sliding slot 311 on the housing 3, and a substantially L-shaped key 11 fixedly connected to the free end of the shank 12 and supported on the outside wall of the housing 3 and movable along the longitudinal sliding slot 311. The frame base 13 defines a space that accommodates a first spring means 15, for example, a piezoelectric device, which automatically returns the slide 1 to the locked state when the slide 1 is released after each operation. The frame base 13 has two upright rods 131 arranged in parallel at the top, a guide way 132 defined between the upright rods 131 for receiving the stop device 2 and allowing transverse movement of the stop device 2 in the guide way 132, two transverse retaining grooves 133 respectively formed on the upright rods 131 at an inner side, and a pair of guide ribs 134 respectively transversely provided at the upright rods 131 at a bottom side for stopping the stop device 2.

For allowing the slide 1 to move relative to the housing 3 smoothly, the frame base 13 has two guide rails 135 longitudinally arranged in parallel at the left and right sides and respectively movably attached to a respective longitudinal track 32 inside the housing 3.

Further, the frame base 13 has an extension wall 14 backwardly extending at one side, a protruding rod 141 perpendicularly extended from the extension wall 14 and pressed on a second spring means 16, for example, a coil spring. The second spring means 16 imparts an upward pressure to the slide 1 such that a young child will not easily press the slide 1 to trigger the ignition system, i.e., the piezoelectric device. The slide 1 further has a protruding strip 142 at the back. When the user holds the slide 1 in the pressed position and moves a release status lock switch 5, the slide 1 is locked in the released state.

Further, an actuating member 143, for example, a bevel face is formed on the rear bottom side of the extension wall 14 for moving a swinging member 4 to pull open the gas valve 63 of a butane well 6, thereby supply fuel gas to a burner 7.

The stop device 2 is a key member bent into shape, having a stop plate 21, a finger strip 22 forwardly extending from the front side of the stop plate 21, a guide strip 23 backwardly extending from the back side of the stop plate 21 below the elevation of the finger strip 21, two retaining blocks 24 respectively transversely protruded from the left and right sides of guide strip 23, two recessed portions 25 respectively defined between the retaining blocks 24 and the stop plate 21, a pin 26 backwardly extending from the stop plate 21 above the guide strip 23, a third spring means 27, for example, a coil spring mounted on the pin 26. The stop device 2 is mounted in the guide way 132 with the two retaining blocks 24 respectively engaged into the two transverse retaining grooves 133 and the third spring means 27 stopped against a transversely extending frame wall 35 in the housing 3. The frame wall 35 has a sliding slot 351 for the passing of the guide strip 23. The guide strip 23 is movable with the stop device 2 along the guide strip 23, causing the third spring means 27 to be compressed or released.

The housing 3 is formed of two cover shells 31 that are abutted against each other, having the aforesaid longitudinal sliding slot 311 and guide way 312 for the passing of the shank 12 and the finger strip 22 respectively. The two longitudinal tracks 32 of the housing 3 are provided for receiving the guide rails 135 of the frame base 13 of the slide 1. A chamber 33 is provided below one longitudinal track 32 to accommodate the second spring means 16, keeping one end of the second spring means 16 stopped against the protruding rod 141 of the slide 1. The housing 3 further has an axle 34 suspending on the inside near the butane well 6 for supporting the swinging member 4 such that the swinging member 4 is turnable about the axle 34 to pull open the gas valve 63 of the butane well 6. The frame wall 35 of the housing 3 is transversely disposed below the guide way 312 to support the third spring means 27. As indicated above, the frame wall 35 has a sliding slot 351 for the passing of the guide strip 23. The frame wall 35 further has two ribs 352 bilaterally disposed below the sliding slot 351 and extending in longitudinal direction to a predetermined depth to enhance the structural strength of the sliding slot 351. Further, a guard 36 is protruding from the front side of the housing 3 for the resting of the forefinger when operating the gas burner.

During operation, the thumb is pressed on the stop device 2 to lower the retaining blocks 24 and to further disengage the retaining blocks 24 from the retaining grooves 133, thereby releasing the stop device 2 from the locked state. At this time, keep pressing the thumb downwards to move the against the L-shaped key 11 of the slide 1, causing the guide rails 135 of the frame base 13 of the slide 1 to move along the two longitudinal tracks 32 of the housing 3 so that the retaining blocks 24 are moved to the bottom side of guide ribs 134. During this action, the frame base 13 and the protruding rod 141 are respectively forced against the first spring means 15 and the second spring means 16, causing one electrode 151 of the ignition system (piezoelectric device) to produce sparks that burn the fuel gas ejected out of the burner 7 to produce a flame.

When released the slide 1, the first spring means 15 and the second spring means 16 are respectively returned to their former shape and to push the frame base 13 and the protruding rod 141, thereby moving the slide 1 upwards. When the retaining grooves 133 are moved to the top side of the retaining blocks 24, the third spring member 27 extends out to force the retaining blocks 24 into engagement with the retaining grooves 133 again, and therefore the finger strip 22 is forced out of the housing 3 and the stop plate 21 is stopped against the inside wall of the housing 3, i.e., the safety structure is in the locked state.

To form a gas burner, the housing 3 has a bottom cuff 37, a serrated rib 371 protruding from the inner side of the bottom cuff 37, at least one pair of retaining notches 372 formed on the serrated rib 371 for securing the butane well 6, a top neck 38 upwardly extending from the center of the top side, a positioning hole 381 defining in the top neck 38 for securing the burner 7, and an outer thread 382 extending around the top neck 38 for fastening to an external apparatus (this will be discussed further).

The swinging member 4 is a lever, having a center pivot hole 41 coupled to the axle 34 such that the swinging member 4 is turnable about the axle 34. The swinging member 4 is a L-shaped member having one end, namely, the driving end 43 coupled to the gas valve 63 of the butane well 6, and the other end, namely, the driven end 42 disposed in contact with the an actuating member 143 of the extension wall 14 of the slide 1. When the user lowers the slide 1 relative to the housing 3, the actuating member 143 moves the driven end 42 of the swinging member 4, thereby causing the driving end 43 of the swinging member to lift the gas valve 63 of the butane well 6 from the close position to the open position to discharge butane (fuel gas). The driving end 43 has a coupling hole 431 for receiving the gas valve 63. The driven end 42 has a protrusion 421 disposed in close contact with the actuating member 143.

The release status lock switch 5 is mounted in a hole 313 on the housing 3 near the front side, having a stop block 51. When the slide 1 is pressed and the swinging member 4 is driven to open the gas valve 63, the user can operate the release status lock switch 5 from an unlocking position to a locking position where the stop block 51 is moved to the top side of the protruding strip 142 to prohibit upward movement of the protruding strip 142, and therefore the slide 1 is locked in the released state, and fuel gas is been continuously supplied to the burner 7.

Figure 3:
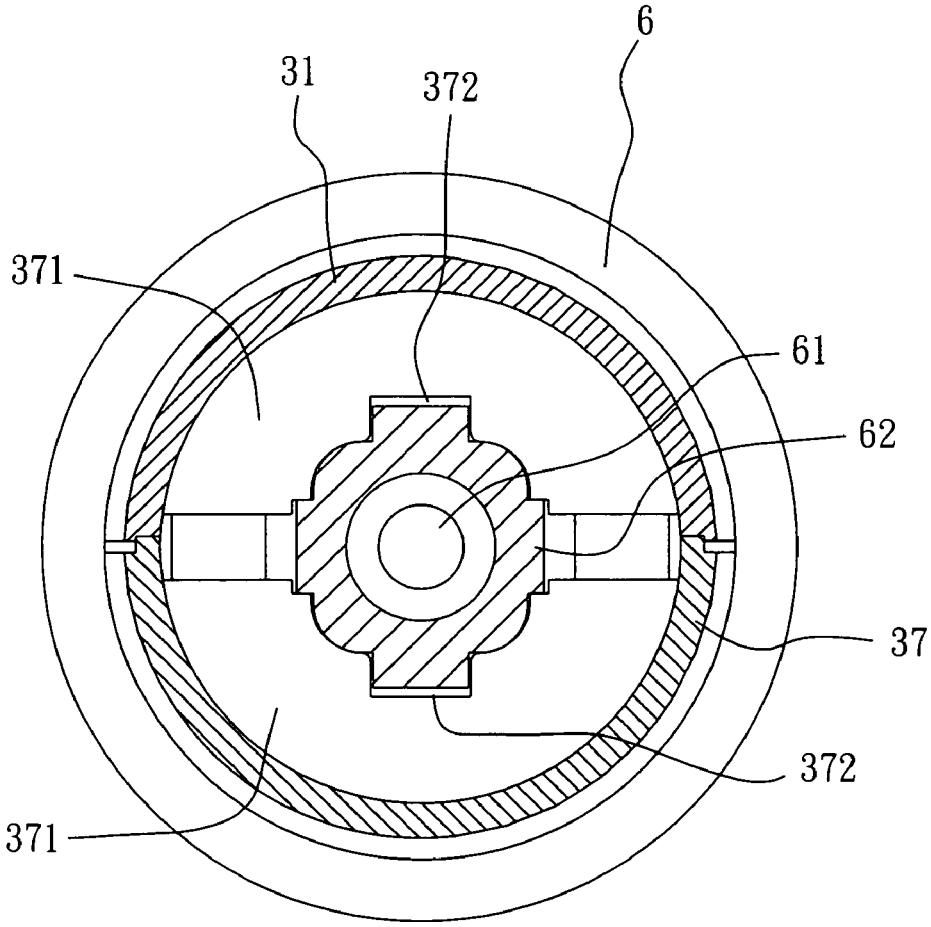
FIG. 3 is a sectional view of the present invention, showing the positioning of the butane well in the housing.

Referring to FIGS. 1 and 3, the butane well 6 is a container holding a liquid fuel gas, having a top connector 61 fastened to the bottom cuff 37 of the housing 3, and a plurality of locating blocks 62 protruded from the top connector 61 and respectively engaged into the retaining notches 372. The gas valve 63 is supported on an absorptive seat 64 at the top side of the top connector 61. A flame adjustment wheel 64 is provided and operable to regulate the flow rate of fuel gas passing out of the gas valve 63. A handle 641 is fastened to the flame adjustment wheel 64 and extended out of a hole 314 of the housing 3 for operation by the user to rotate the flame adjustment wheel 64 with less effort. The filling valve 65 is provided at the bottom side of the butane well 6, having a relatively longer filling tube 651 and a relatively shorter exhaust tube 652 concentrically arranged inside the butane well 6 for filling fuel gas into the butane well 6 and for overpressure protection. Because the structure of the filling valve 65 is of the known art, further detailed description in this regard is not necessary.

Figure 5:
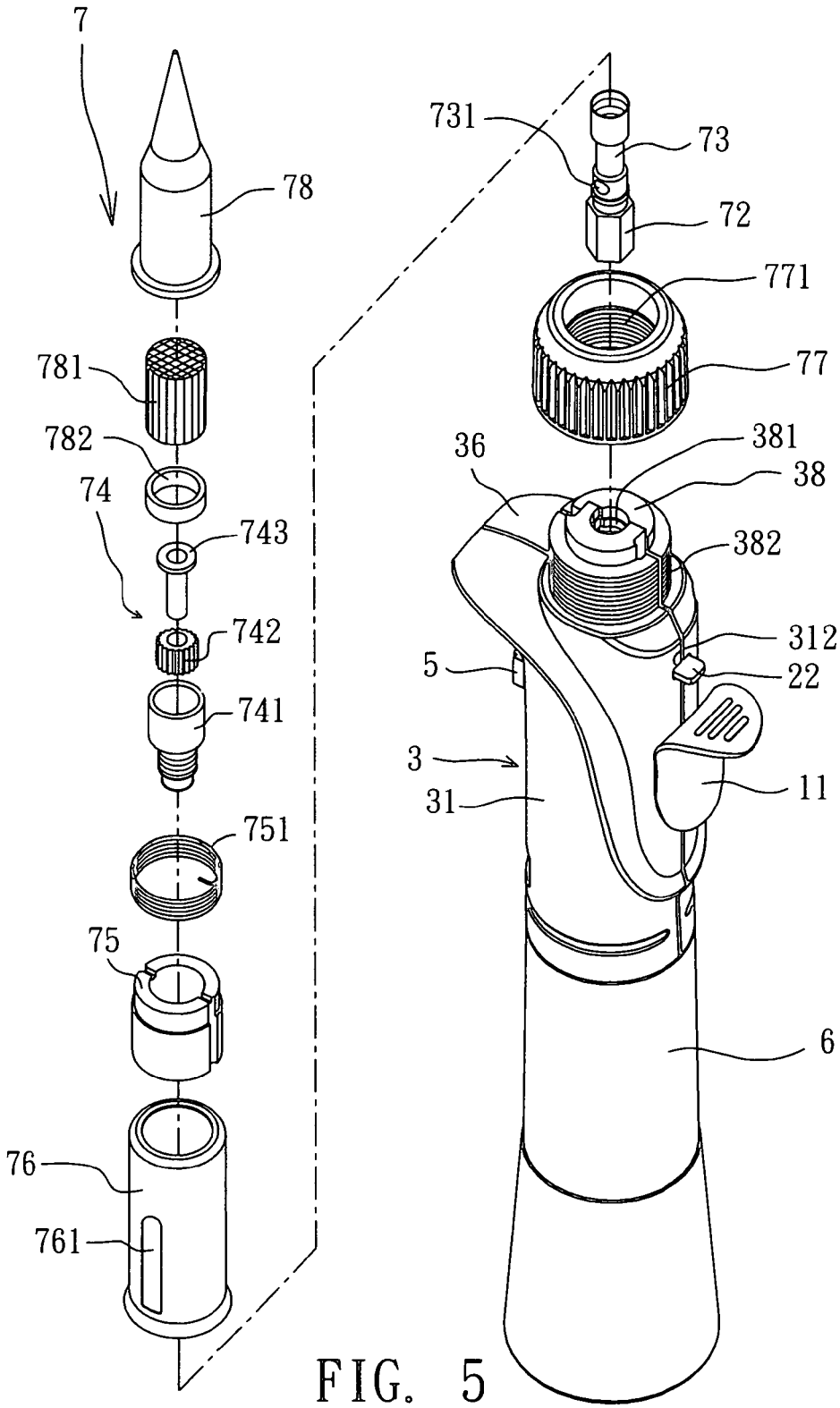
FIG. 5 is an exploded view of a gas burner constructed according to one example of the present invention.

Referring to FIGS. 1 and 5, the burner 7 is a known product, comprising a flexible gas tube 71 connected to the gas valve 63, a gas nozzle 72 connected between one end of the flexible gas tube 71 remote from the gas valve 63 and a mixing tube 73 that is fixedly mounted in the positioning hole 381 of the top neck 38 of the housing 3 and has at least one air hole 731 for receiving outside air for mixing with discharged fuel gas for combustion, a flame nozzle 74 connected to the mixing tube 73.

The flame nozzle 74 is comprised of a gear holder 741, a flame gear 742 mounted in the gear holder 741, a lock pin 743 inserted through the center of the flame gear 742 and fastened to the gear holder 741 to affix the flame gear 742 to the gear holder 741. Further, a heat insulative ring 75 is provided around the flame nozzle 74 for protection. A discharging electrode 751 is mounted on the heat insulative ring 75. During operation of the gas burner, a high voltage is transmitted through the gas nozzle 72 and the mixing tube 73 to the flame nozzle 74 and then discharged out of the discharging electrode 751, thereby producing sparks to burn discharged fuel gas around the flame nozzle 74.

Figure 4:
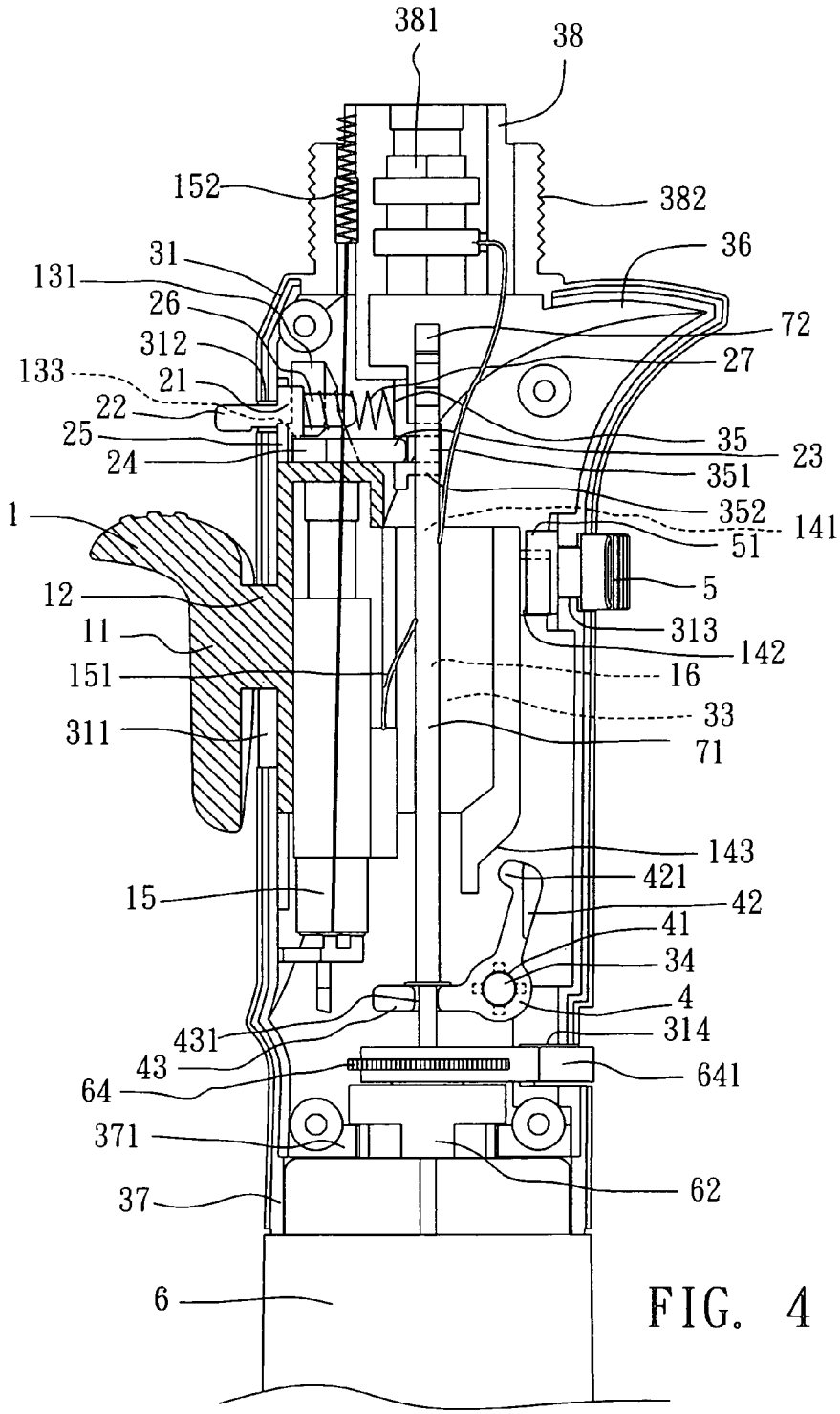
FIG. 4 is a schematic sectional view showing the structure of the gas burner according to the present invention.

Further, a sleeve 76 is sleeved onto the heat insulative ring 75 and a lock ring 77 is fastened with its inner thread 711 to the outer thread 382 of the top neck 38 to lock the sleeve 74 and the flame nozzle 74. The sleeve 76 has an air hole 761 corresponding to the air hole 731 of the mixing tube 73 for guiding in air. The stop device 2 is released from the locked state, the slide 1 is pressed to compress the first spring means 15, i.e., the piezoelectric device, causing the electrode 151 to contact the gas nozzle 72. Thus, a high voltage goes through the mixing tube 73 and the flame nozzle 74, thereby causing sparks to be produced between the discharging electrode 751 and the flame nozzle 74 to burn discharged fuel gas. Referring to FIG. 4, a metal contact member 152 is provided in the positioning hole 381 for the contact of the sleeve 76, and a lead wire 153 is connected between the metal contact member 152 and the first spring means 15, i.e., the piezoelectric, thereby forming a loop.

Figure 6:
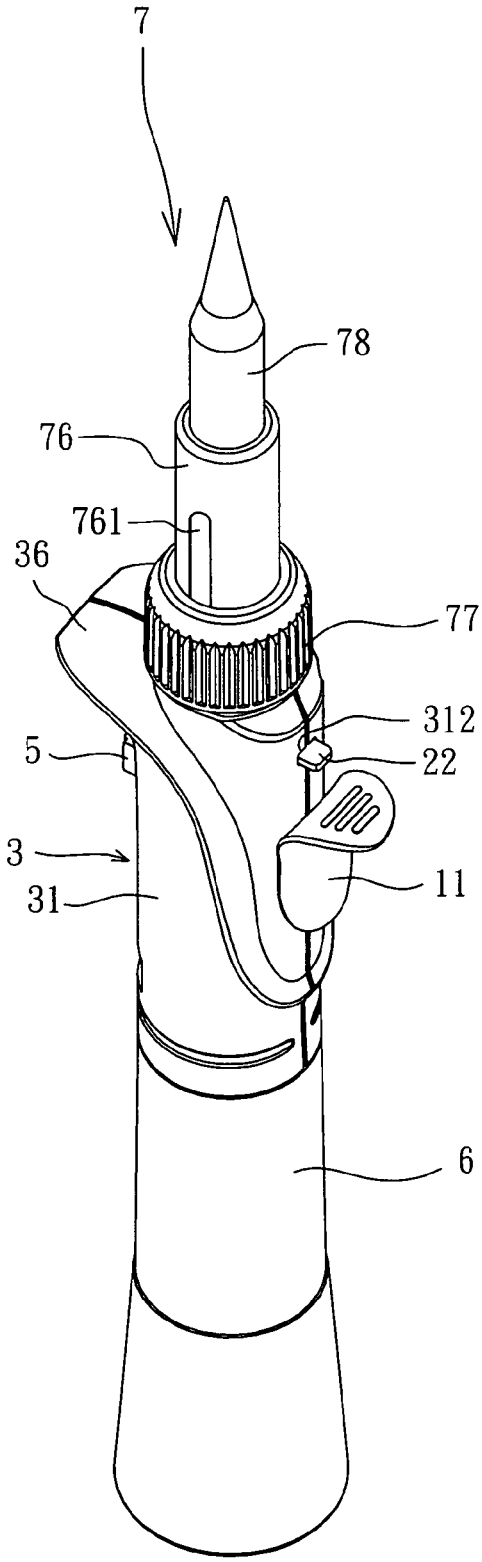
FIG. 6 is an elevational assembly view of FIG. 5.

Further, an iron tip 78 is provided at the front side of the sleeve 76, having a heating member 781 and a locating ring 782 provided on the inside. During burning of discharged fuel gas, the iron tip 78 is heated. Thus, the gas burner is sued as a gas iron as shown in FIGS. 5 and 6.

Figure 7:
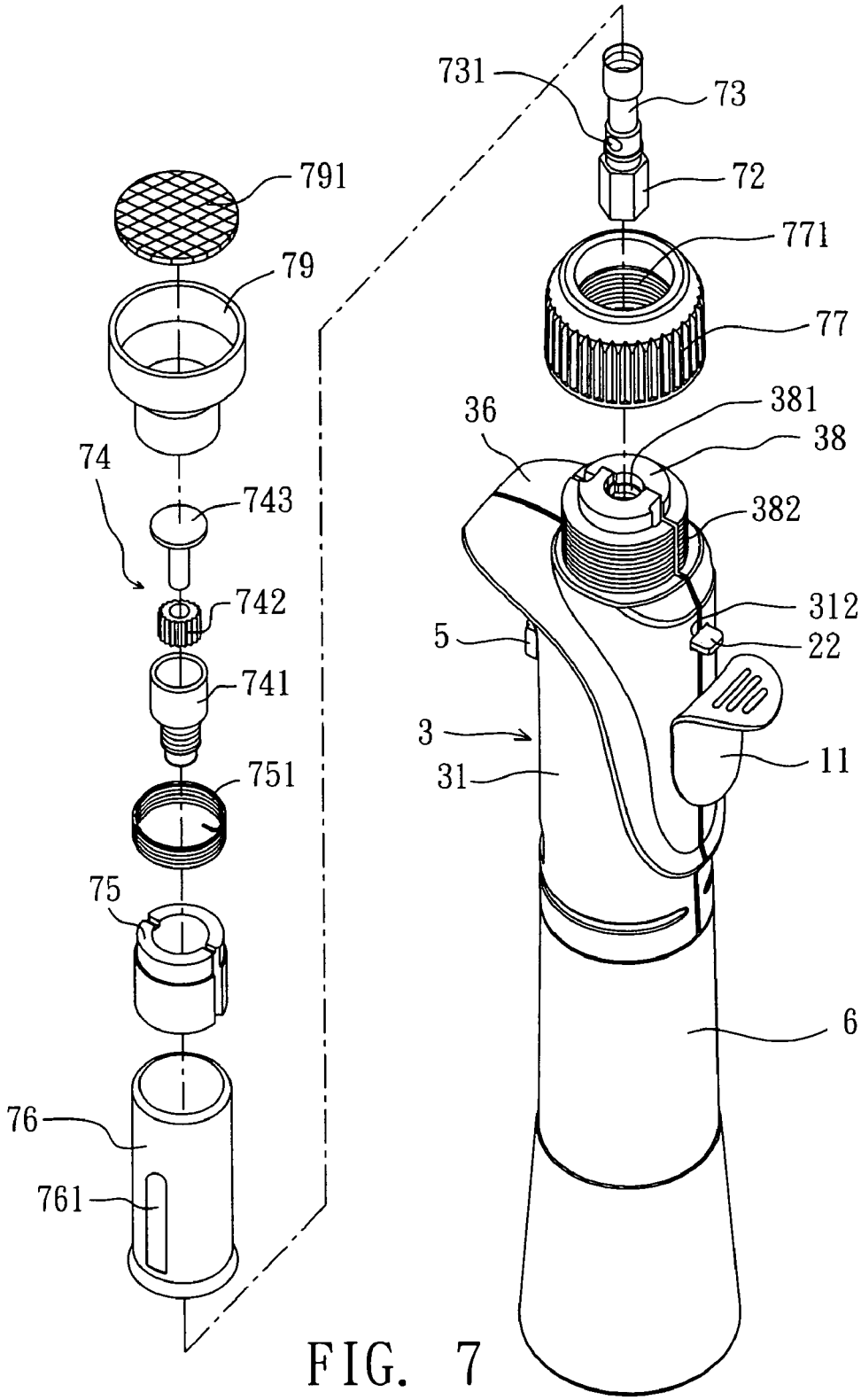
FIG. 7 is an exploded view of a gas burner constructed according to another example of the present invention.

Referring to FIG. 7, the heat plate holder 79 may be used to substitute for the aforesaid iron tip 78 and affixed to the top side of the sleeve 76 to hold a heat plate 79.

By means of the application of the present invention, the slide and the stop device constitute a double-safety switch, preventing a child playing the gas burner for fun from triggering the gas burner. When released the slide or unlock the release-lock switch, all the parts are returned to their former position to cut off the supply of fuel gas and to extinguish the flame. The auto-locking design of the present invention is a design of human technology. Further, during operation of the gas burner, the user must overcome the resisting force of the first and second spring means. A young child is not easy to overcome the resisting force of the first and second spring means, preventing triggering of the ignition system accidentally. Further, the parts of the invention are of modularized design, convenient for installation. According to the present invention, the gas burner can be made in any of a variety of forms for different applications.

While only one embodiment of the present invention has been shown and described, it will be understood that various modifications and changes could be made thereunto without departing from the spirit and scope of the invention disclosed.

What is claimed is:

1. A safety structure of a gas burner, comprising:

a slide, said slide having a frame base accommodating a first spring means, a key from said frame base, two upright rods arranged in parallel at a top side of said frame base, a guide way defined between said upright rods, two transverse retaining grooves respectively formed on said upright rods at an inner side, and a pair of guide ribs respectively transversely provided at said upright rods at a bottom side;

a stop device received in said sliding way of said slide, said stop device having a stop plate, a finger strip forwardly extending from said stop plate, a guide strip and a pin backwardly extending from said stop plate, two retaining blocks respectively extended from left and right sides of said stop plate for engaging the retaining grooves of said slide to lock said slide, two recessed portions respectively defined between the stop plate and the retaining blocks, and a third spring means mounted on said pin; and a housing formed of two cover shells, said housing having a longitudinal sliding slot and a guide way for the passing of said key and said finger strip respectively, a frame wall transversely disposed below said guide way and stopped against said third spring means, and a sliding slot cut through said frame wall for the passing of said guide strip;

wherein when the user presses said slide, said third spring will be compressed to lower said stop device and to further disengage said retaining blocks from said retaining grooves, thereby releasing said stop device from the constraint of said slide; when the user keeps pressing said slide at this time, said retaining blocks will be moved to a bottom side of said guide ribs and said frame base will be forced to squeeze said first spring means to release the locked state.

2. The safety structure of a gas burner as claimed in claim 1, wherein said slide has a shank connected between one side of said frame base and said key and inserted through the longitudinal sliding slot of said housing.

3. The safety structure of a gas burner as claimed in claim 1, wherein said first spring means is a piezoelectric device having an electrode extending to one side of a flame nozzle.

4. The safety structure of a gas burner as claimed in claim 1, wherein said frame base has two guide rails longitudinally arranged in parallel at two opposite sides and adapted to guide movement of said slide relative to said housing.

5. The safety structure of a gas burner as claimed in claim 1, wherein said frame base of said slide has an extension wall backwardly extending one side thereof, a protruding rod perpendicularly extended from said extension wall, and a second spring means connected to said protruding rod; said housing has chamber accommodating said second spring means for enabling said second spring means to be compressed when said slide is moved.

6. The safety structure of a gas burner as claimed in claim 1, further comprising a swinging member, said swinging member having a center pivot hole coupled to an axle inside said housing, a driving end coupled to a gas valve of a butane well, and a driven end connected to said slide, said swinging member being turned about said axle to lift open said gas valve when said slide is pressed.

7. The safety structure of a gas burner as claimed in claim 6, wherein said driving end of said swinging member has a coupling hole coupled to said gas valve, and said driven end of said swinging member has a protrusion disposed in close contact with a beveled face of said actuating member.

8. The safety structure of a gas burner as claimed in claim 1, further comprising a release-lock switch mounted in a hole on said housing, said release-lock switch having a front stop block movable from an unlocking position to a locking position above a protruding strip of said slide to prohibit upward movement of said slide and to lock said slide in the released state after said slide has pressed and said swinging member has been driven to open said gas valve.

9. The safety structure of a gas burner as claimed in claim 1, wherein said frame wall of said housing has two ribs bilaterally disposed below the sliding slot of said frame wall and extending in longitudinal direction to a predetermined depth to enhance the structural strength of the sliding slot.

10. The safety structure of a gas burner as claimed in claim 1, further comprising a guard protruding from a front side of said housing.

11. The safety structure of a gas burner as claimed in claim 1, further comprising a butane well holding a liquid fuel gas, said butane well having a top connector fastened to said housing, and a plurality of locating blocks protruded from said top connector and respectively engaged into respective retaining notches in a bottom cuff of said housing, a gas valve supported on an absorptive seat at a top side of said top connector, a flame adjustment wheel operable to regulate the flow rate of the fuel gas passing out of said butane well through said gas valve, and a handle fastened to said flame adjustment wheel and extended out of a hole of said housing for operation.

12. The safety structure of a gas burner as claimed in claim 11, further comprising a burner, said burner comprising a flexible gas tube connected to said gas valve3, a gas nozzle connected between one end of said flexible gas tube remote from said gas valve and a mixing tube that is fixedly mounted in a positioning hole of a top neck of said housing and has at least one air hole for receiving outside air for mixing with discharged fuel gas for combustion, a flame nozzle connected to said mixing tube, and a heat insulative ring mounted around said flame nozzle for protection.

13. The safety structure of a gas burner as claimed in claim 12, further comprising a sleeve sleeved onto said heat insulative ring, and a lock ring adapted to lock said sleeve and said flame nozzle to said housing.

14. The safety structure of a gas burner as claimed in claim 12, wherein said sleeve has an air hole corresponding to the air hole of said mixing tube for guiding in air.

15. The safety structure of a gas burner as claimed in claim 13, wherein said sleeve has a front side fixedly mounted with an iron tip.

16. The safety structure of a gas burner as claimed in claim 13, wherein said sleeve has a front side fixedly mounted with a heat plate.

* * * * *